US008995235B2

(12) United States Patent
Honda et al.

(10) Patent No.: US 8,995,235 B2
(45) Date of Patent: Mar. 31, 2015

(54) ELECTRONIC TIMEPIECE

(75) Inventors: Katsuyuki Honda, Nagano-ken (JP); Norimitsu Baba, Nagano-ken (JP); Jun Matsuzaki, Nagano-ken (JP); Toshikazu Akiyama, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 242 days.

(21) Appl. No.: 13/594,239

(22) Filed: Aug. 24, 2012

(65) Prior Publication Data

US 2013/0051185 A1 Feb. 28, 2013

(30) Foreign Application Priority Data

Aug. 30, 2011 (JP) ..... 2011-187590

(51) Int. Cl.
*G04C 3/00* (2006.01)
*G04R 20/04* (2013.01)
*G04G 19/08* (2006.01)

(52) U.S. Cl.
CPC ..... *G04R 20/04* (2013.01); *G04G 19/08* (2013.01)
USPC ..... 368/47; 368/204

(58) Field of Classification Search
USPC ..... 368/203–204, 47; 342/357.63
See application file for complete search history.

(56) References Cited

U.S. PATENT DOCUMENTS

| | | | | |
|---|---|---|---|---|
| 6,643,223 | B2 * | 11/2003 | Fujisawa | 368/204 |
| 7,079,451 | B2 * | 7/2006 | Okeya | 368/47 |
| 7,102,964 | B2 * | 9/2006 | Fujisawa | 368/66 |
| 7,423,935 | B2 * | 9/2008 | Oguchi | 368/47 |
| 7,649,812 | B2 * | 1/2010 | Baba | 368/47 |
| 8,749,403 | B2 * | 6/2014 | King et al. | 340/932.2 |

FOREIGN PATENT DOCUMENTS

| | | |
|---|---|---|
| JP | 2002-267734 | 9/2002 |
| JP | 2005-221449 | 8/2005 |
| JP | 2011-075380 | 4/2011 |
| JP | 2011-127902 | 6/2011 |

* cited by examiner

*Primary Examiner* — Sean Kayes

(57) ABSTRACT

An electronic timepiece can adjust the input terminal and suppress power consumption. An electronic timepiece has: a reception unit 8 that receives a satellite signal containing time information from a positioning information satellite; a power supply unit 4 having a battery that supplies drive power; a remaining capacity detection unit 5 that measures the remaining battery capacity; and a control unit 9 that controls satellite signal reception by the reception unit 8. The control unit 9 includes a timekeeping unit 91 that keeps time, a time adjustment unit 99 that adjusts the time kept by the timekeeping unit 91 based on the satellite signal received by the reception unit 8, and a prohibition period setting unit 93 that sets a prohibition period in which receiving a satellite signal is prohibited based on the remaining battery capacity measured by the remaining capacity detection unit 5.

8 Claims, 6 Drawing Sheets

ELECTRONIC TIMEPIECE

BACKGROUND

1. Technical Field

The present invention relates to an electronic timepiece, and relates more particularly to an electronic timepiece that receives satellite signals transmitted from positioning information satellites such as GPS satellites and acquires current time information.

2. Related Art

The global positioning system (GPS) is a system for determining one's own location, and uses GPS satellites orbiting the Earth. Each GPS satellite has an on-board atomic clock, and each GPS satellite uses the atomic clock to keep time with extremely high precision (referred to as the GPS time or satellite time information). This time information is carried in the satellite signals transmitted by each GPS satellite, and electronic timepieces that receive these satellite signals, acquire the time information, and adjust the internal time of the electronic timepiece are known from the literature. See, for example, Japanese Unexamined Patent Appl. Pub. JP-A-2005-221449.

Receiving a satellite signal to adjust the internal time requires a relatively large amount of power. The timepiece taught in JP-A-2005-221449, however, receives the satellite signal and adjusts the internal time at a specific time interval regardless of the remaining battery capacity. As a result, receiving a satellite signal may consume significant power to drive the device even though the remaining battery capacity is low, and could shorten the time that the device can be driven, possibility resulting in a sudden system shutdown.

SUMMARY

An electronic timepiece according to the invention enables adjusting the internal time while suppressing power consumption.

A first aspect of the invention is an electronic timepiece including: a reception unit that receives a satellite signal containing time information from a positioning information satellite; a power supply unit having a battery that supplies drive power; a remaining capacity detection unit that measures the remaining battery capacity; and a control unit that controls satellite signal reception by the reception unit, and includes a timekeeping unit that keeps time, a time adjustment unit that adjusts the time kept by the timekeeping unit based on the satellite signal received by the reception unit, and a prohibition period setting unit that sets a prohibition period in which receiving a satellite signal is prohibited based on the remaining battery capacity measured by the remaining capacity detection unit.

An example of a positioning information satellite is a GPS satellite as described above. When the positioning information satellite is a GPS satellite, an example of the time information contained in the satellite signal is the Z count contained in the navigation message, which is the satellite signal from the GPS satellite.

The time adjustment unit in this aspect of the invention adjusts the time kept by the timekeeping unit (also referred to herein as the "internal time") based on the time information contained in the satellite signal received by the reception unit. As a result, the electronic timepiece can keep the correct time.

The prohibition period setting unit sets the prohibition period that prohibits the reception unit from receiving satellite signals according to the remaining battery capacity monitored by the remaining capacity detection unit. The reception process, which requires a relatively large amount of power, therefore does not run during the prohibition period, and the power needed to drive the electronic timepiece can be assured.

The internal time can therefore be adjusted and the correct time kept while power consumption by frequently receiving satellite signals can be suppressed. The electronic timepiece can therefore be driven for a longer time, and sudden system shutdowns caused by insufficient power can be suppressed.

Preferably, the prohibition period setting unit sets a first prohibition period as the prohibition period when the remaining battery capacity is greater than or equal to a specific threshold, and sets a second prohibition period that is longer than the first prohibition period as the prohibition period when the remaining battery capacity is less than the threshold.

The prohibition period set when the remaining battery capacity is less than a specific threshold in this aspect of the invention is longer than the prohibition period set when the remaining capacity is greater than or equal to the specific threshold. As a result, a short prohibition period is set when the remaining battery capacity is sufficient, and the ability to receive satellite signals can be restored in a short time. The time can therefore be adjusted as needed, and the difference between the internal time and the actual current time can be decreased. In addition, because a long prohibition period is set when the remaining battery capacity is low, the power needed for electronic timepiece operations other than receiving satellite signals can be reliably assured.

Further preferably, the control unit has a restriction cancelling unit that cancels the prohibition period when the remaining battery capacity becomes greater than or equal to a specific value that is higher than the threshold.

If power is supplied to the battery of the power supply unit, the battery is charged, the remaining battery capacity is sufficient, and the prohibition period still remains set, satellite signals cannot be received and the internal time cannot be adjusted.

However, because the restriction cancelling unit in this aspect of the invention cancels the prohibition period when the remaining battery capacity is a specific value that is higher than the threshold, the reception unit becomes able to receive satellite signals in this situation. By thus increasing the frequency of satellite signal reception when the remaining battery capacity is sufficient, a more accurate current time can be kept.

Yet further preferably, cancellation of the prohibition period by the restriction cancelling unit is once a day.

If the restriction cancelling unit cancels the prohibition period every time the remaining battery capacity goes above the specific value (threshold), setting and cancelling the prohibition period could repeat frequently depending upon how high the specific value is set. Because these operations also consume power, frequent execution can also result in reducing the remaining battery capacity.

However, because the restriction cancelling unit cancels the prohibition period only once a day in this aspect of the invention, these processes are not executed frequently, and unnecessary power consumption can be suppressed. Power for driving the electronic timepiece can therefore be assured even more reliably.

In another aspect of the invention, the prohibition period setting unit sets a third prohibition period that is longer than the second prohibition period as the prohibition period when the remaining battery capacity is less than the threshold and is greater than or equal to a second threshold.

When the remaining battery capacity is less than the threshold value, this aspect of the invention increases the length of the set prohibition period as the remaining battery capacity decreases. As a result, the frequency of receiving satellite signals, which requires significant power, can be suppressed. The power needed for electronic timepiece operations other than receiving satellite signals can also be assured even more reliably.

In another aspect of the invention, the control unit preferably includes an automatic reception unit that executes an automatic reception process causing the reception unit to receive the satellite signal when the state of the electronic timepiece matches a specific reception condition, and a manual reception unit that executes a manual reception process causing the reception unit to receive the satellite signal when a specific operation of the electronic timepiece is performed; and the prohibition period set by the prohibition period setting unit for automatic reception is longer than the prohibition period set for manual reception.

Some users frequently receive a satellite signal and adjust the time. As a result, by setting the prohibition period for automatic reception longer than the prohibition period for manual reception, in other words, by setting the prohibition period for manual reception shorter than the prohibition period for automatic reception, prohibition of manual reception can be cancelled sooner than the prohibition of automatic reception. This enables receiving satellite signals in response to a user operation easier, and improves the ease of use of the electronic timepiece.

In another aspect of the invention, the automatic reception unit preferably includes a first condition evaluation unit that determines if the electronic timepiece is in an environment where the satellite signal can be received, and an environment-based automatic reception unit that causes the reception unit to receive the satellite signal when the first condition evaluation unit determines that the environment enables reception.

Examples of environments in which satellite signals can be received are outdoors and beside a window.

If the prohibition period is not set and the first condition evaluation unit determines that the electronic timepiece is in an environment where satellite signals can be received, the environment-based automatic reception unit causes the reception unit to receive the satellite signal. Because the satellite signal reception process is therefore executed when it is determined that satellite signal reception has become possible, frequent execution of the reception process can be suppressed. Unnecessary power consumption can therefore also be suppressed.

Another aspect of the invention, preferably also has a power generating unit that produces power according to incident light and charges the battery; and a power output detection unit that detects the power output of the power generating unit; wherein the first condition evaluation unit determines if the environment enables receiving the satellite signal based on the power output detected by the power output detection unit.

A configuration having a solar panel is one example of a power generating unit.

Because the power generating unit produces power according to the amount of incident light, power output increases as the amount of light increases. In other words, high power output can be used to determine a condition with strong incident light, such as sunlight. As a result, if the first condition evaluation unit determines that the power output from the power generating unit detected by the power output detection unit is relatively high, sunlight can be determined to be incident to the power generating unit, and the electronic timepiece can be determined to be outdoors or at a window. Because satellite signals can be received in such locations, the first condition evaluation unit can detect whether or not the electronic timepiece is in an environment where satellite signals can be received based on the power output of the power generating unit. In addition to being able to appropriately determine if the electronic timepiece is in an environment where satellite signals can be received, executing the satellite signal reception process in an environment where reception is not possible can be suppressed, and unnecessary power consumption can be suppressed.

Yet further preferably, the automatic reception unit has a second condition evaluation unit that determines if the time kept by the timekeeping unit reached a preset automatic reception time, and a scheduled automatic reception unit that receives the satellite signal by the reception unit when the second condition evaluation unit determines that the automatic reception time was reached.

When a prohibition period is not set and the second condition evaluation unit determines that the time kept by the timekeeping unit reached the automatic reception time, the scheduled automatic reception unit causes the reception unit to receive satellite signals. Satellite signals can therefore be received and the internal time adjusted when satellite signal reception is possible without the user starting manual reception. The ease of use of the electronic timepiece can therefore be improved.

Other objects and attainments together with a fuller understanding of the invention will become apparent and appreciated by referring to the following description and claims taken in conjunction with the accompanying drawings.

DESCRIPTION OF EMBODIMENTS

Wristwatch Functions

A preferred embodiment of the invention is described below with reference to the accompanying figures.

Figure 1:
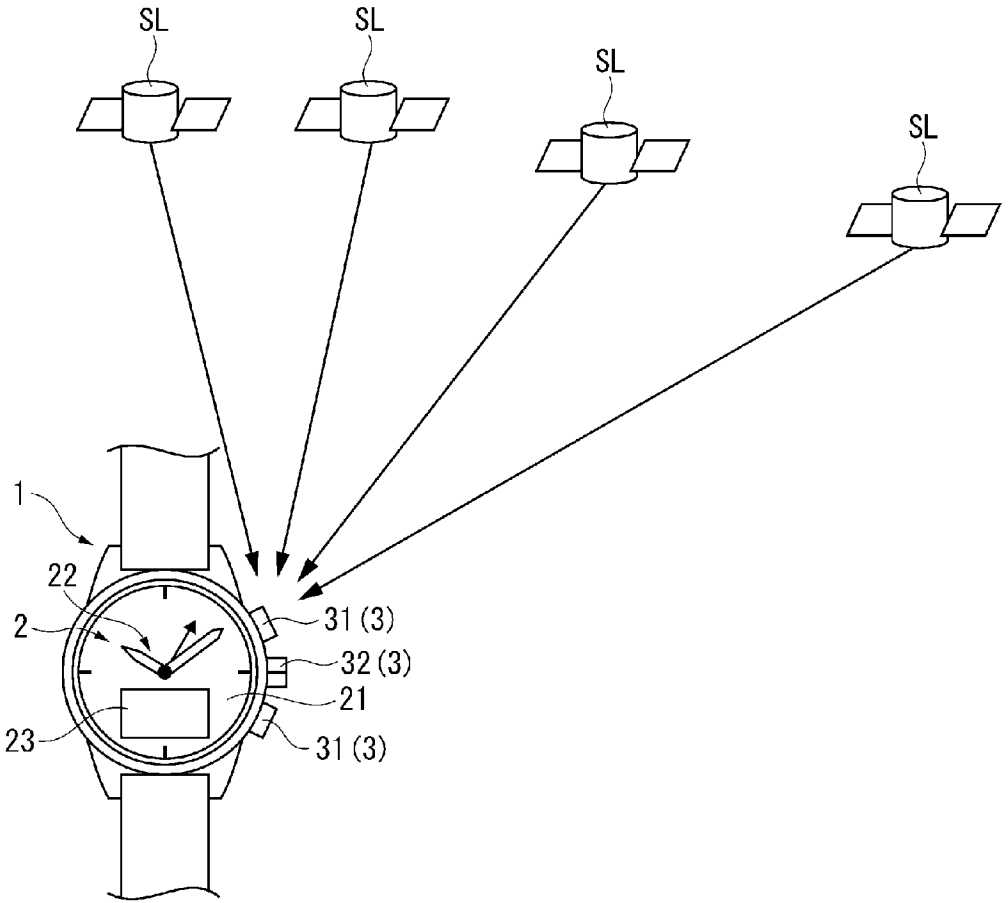
FIG. 1 shows the configuration of a wristwatch according to a preferred embodiment of the invention and how the electronic timepiece is used.

FIG. 1 shows the configuration of a wristwatch 1 according to this embodiment of the invention and how the wristwatch 1 is used.

The wristwatch 1 according to this embodiment of the invention is a wristwatch with a GPS time adjustment function. As shown in FIG. 1, the wristwatch 1 is an electronic timepiece that receives satellite signals (GPS signals) carrying time information and positioning information from a plurality of GPS satellites SL circling the Earth on known orbits in space, and adjusts the internal time information denoting the internally kept time and displays the current location based on the received time information and positioning information. Note that a GPS satellite SL is one example of a positioning information satellite in the invention and four GPS satellites SL are shown in FIG. 1, but there are currently approximately 30 GPS satellites SL in orbit, and satellite signals can normally be received from 8 to 11 GPS satellites SL when outdoors.

This wristwatch 1 has a display unit 2 and an operating unit 3.

The display unit 2 displays information from the wristwatch 1. The display unit 2 includes a dial 21 and hands 22, a stepper motor (not shown in the figure) that drives the hands 22, and a display 23 that is exposed in a window formed in the dial 21.

The dial 21 and hands 22 display the current time based on the internal time information, for example. The hands 22 include a second hand, minute hand, and hour hand, and these hands are driven by the stepper motor through a wheel train.

The display 23 is an LCD panel in this embodiment, and displays information identifying the current position, which is calculated based on positioning information contained in the satellite signals described above, and specific messages as controlled by a controller 9 described below.

The operating unit 3 includes buttons 31 and a crown 32, and the wristwatch 1 executes various functions in response to specific button 31 and crown 32 operations.

Wristwatch Circuit Configuration

Figure 2:
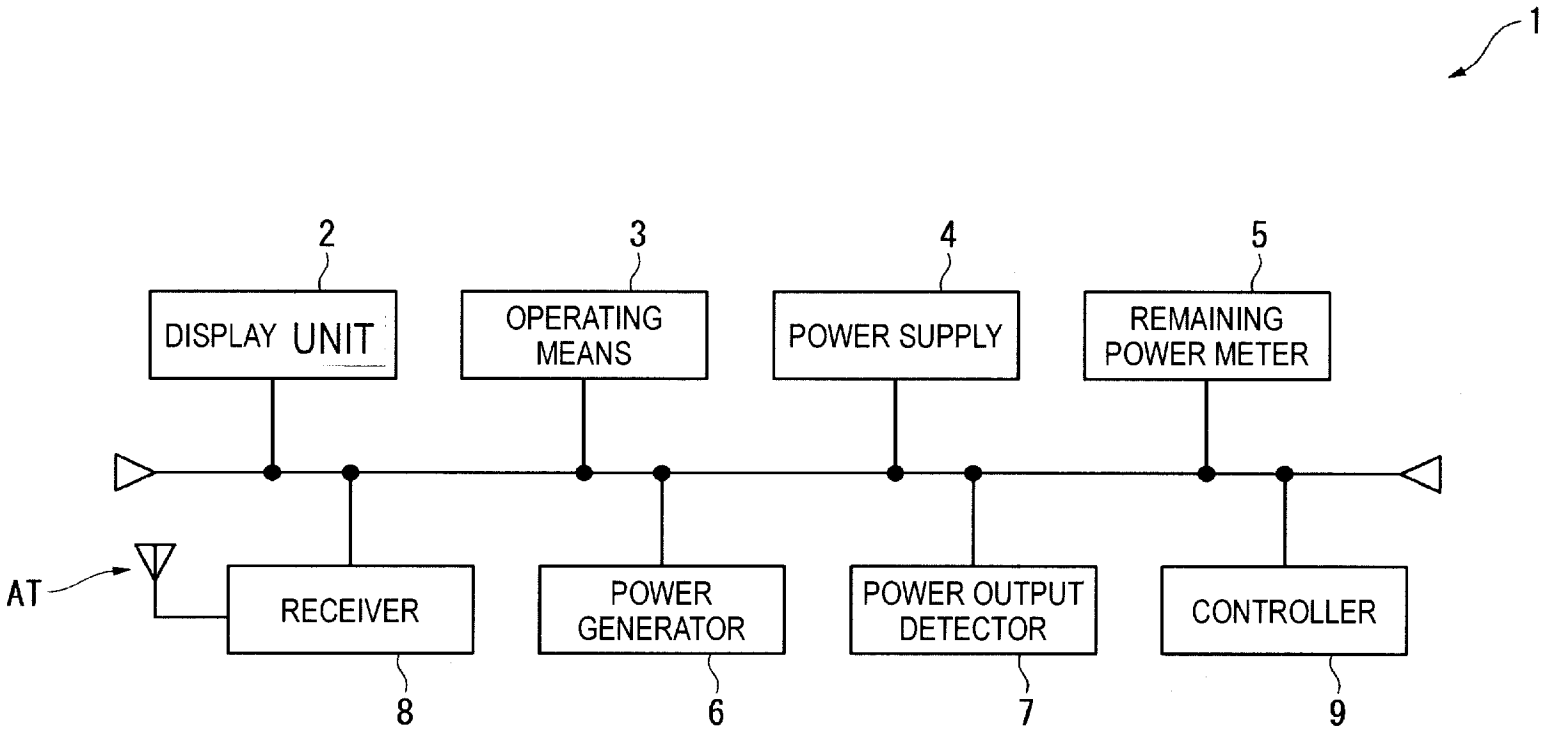
FIG. 2 is a block diagram showing the circuit configuration of the wristwatch according to this embodiment of the invention.

FIG. 2 is a block diagram of the circuit configuration of the wristwatch 1.

In addition to the display unit 2 and operating unit 3 described above, the wristwatch 1 also has a power supply 4, remaining power meter 5, power generator 6, power output detector 7, receiver 8, and controller 9 connected together over a common bus as shown in FIG. 2.

The power supply 4 includes a storage battery (also referred to as simply "battery" below).

The remaining power meter 5 detects the battery voltage of the power supply 4, and monitors the remaining battery capacity of the power supply 4. Note that the remaining power meter 5 is not limited to a configuration that detects the battery voltage, and could be configured to measure the remaining battery capacity by monitoring input power to the power supply 4 and output power from the power supply 4.

The power generator 6 is not shown in detail in the figures, but includes a solar panel disposed on the front or back side of the dial 21, supplies power produced from light incident to the solar panel to the power supply 4, and charges the battery of the power supply 4.

The power output detector 7 detects the electric energy (generated energy) generated by the power generator 6. More specifically, the power output detector 7 detects the voltage output from the power generator 6, and based thereon detects the energy generated per unit time by the power generator 6.

The receiver 8 is connected to an antenna AT disposed inside the wristwatch 1, and is a module that receives satellite signals through the antenna AT and acquires time information and positioning information from the satellite signals as controlled by the controller 9 described below.

Note that the antenna AT in this embodiment is a patch antenna that can receive satellite signals from a plurality of GPS satellites SL, but the antenna is not so limited and a film antenna or other type of antenna could be used instead.

Configuration of the Controller

Figure 3:
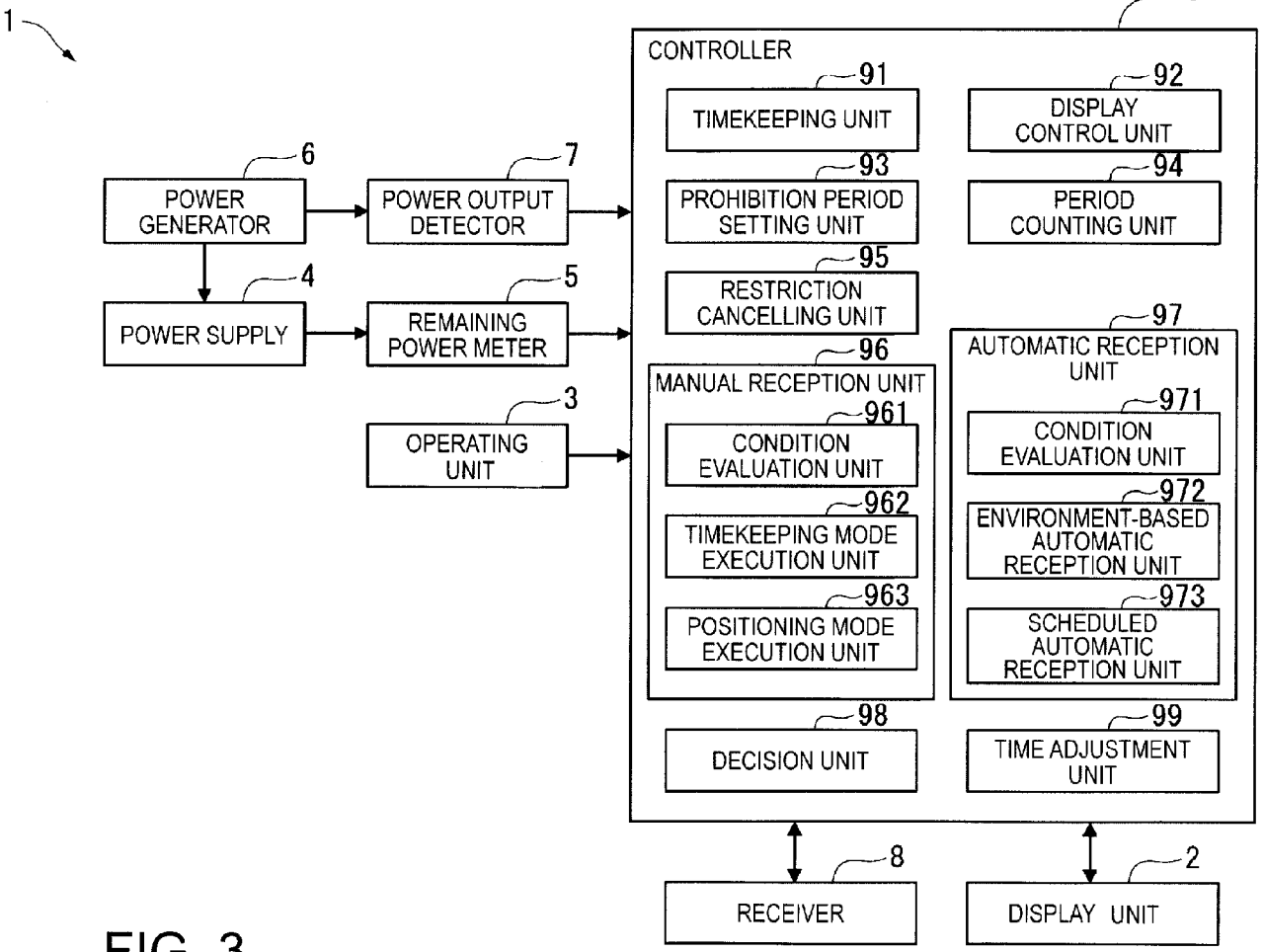
FIG. 3 is a block diagram showing the functions of the wristwatch according to this embodiment of the invention.

FIG. 3 is a function block diagram showing the functions of the controller 9.

The controller 9 is configured as a circuit board on which circuit devices including a CPU (central processing unit), ROM (read-only memory), and RAM (random access memory) are mounted, and controls operation of the wristwatch 1. As a result of the CPU executing a program stored in ROM, the controller 9 functions as a timekeeping unit 91, display control unit 92, prohibition period setting unit 93, period counting unit 94, restriction cancelling unit 95, manual reception unit 96, automatic reception unit 97, decision unit 98, and time adjustment unit 99 as shown in operating unit 3.

The timekeeping unit 91 keeps the internal time.

The display control unit 92 controls the stepper motor and display of the display unit 2 described above, and displays the state of the wristwatch 1 in addition to displaying the internal time with the display unit 2. These wristwatch 1 states include, for example, the status of satellite signal reception, the current position (latitude and longitude) calculated from the positioning information contained in the received satellite signals, the prohibition period set by the prohibition period setting unit 93, the number of days counted by the period counting unit 94, a message indicating the prohibition period is in effect, and how many days are left.

The prohibition period setting unit 93 sets a prohibition period based on the battery voltage of the power supply 4 detected by the remaining power meter 5 after a satellite signal has been received by the manual reception unit 96 or automatic reception unit 97 described below. This prohibition period is a period for which receiving satellite signals from the GPS satellites SL is prohibited, and the prohibition period setting unit 93 sets a separate prohibition period for manual reception by the manual reception unit 96 and automatic reception by the automatic reception unit 97. Note that in this embodiment the prohibition period setting unit 93 sets different prohibition periods for manual reception and automatic reception.

In this embodiment of the invention, when the remaining battery capacity determined by the remaining power meter 5 is greater than or equal to a first threshold (such as 70%), the prohibition period setting unit 93 sets time T11 as the prohibition period for automatic reception and sets time T21 as the prohibition period for manual reception. These times T11, T21 are examples of the first prohibition period in the accompanying claims.

If the remaining battery capacity is less than the first threshold and greater than or equal to a second threshold (such as 50%), the prohibition period setting unit 93 sets the automatic reception prohibition period to a time T12 that is longer than time T11, and sets the manual reception prohibition period to a time T22 that is longer than time T21.

If the remaining battery capacity is less than the second threshold, the prohibition period setting unit 93 sets the automatic reception prohibition period to a time T13 that is longer than time T12, and sets the manual reception prohibition period to a time T23 that is longer than time T22. These times T12, T13, T22, T23 are examples of the second prohibition period in the accompanying claims.

The relationship between the lengths of times T11-T13 is T11<T12<T13, and the relationship between the lengths of times T21-T23 is T21<T22<T23. As a result, as the remaining battery capacity decreases, the prohibition periods for both manual reception and automatic reception become longer.

In addition, the relationship between the lengths of times T11 and T21 is T11>T21, the relationship between the lengths of times T12 and T22 is T12>T22, and the relationship between the lengths of times T13 and T23 is T13>T23. The automatic reception prohibition periods are thus longer than the manual reception prohibition periods.

In this embodiment time T11 is set to 2 days, time T12 is set to 3 days, and time T13 is set to 4 days. Time T21 is set to 1 day, time T22 is set to 2 days, and time T23 is set to 3 days. However, these times (days) are only one example, and could be varied appropriately according to the capacity of the storage battery of the power supply 4. For example, if the accuracy of the internal time kept by the timekeeping unit 91 is +/−15 seconds per month and the time is not adjusted for 2 days, the internal time and the current time could differ by 1 second or more, and this difference will be obvious on a display unit 2 that displays the time with seconds. By setting the length of times T11 to T13 and T21 to T23 to less than 2 days in this case, the maximum difference between the internal time and the current time can be kept to less than 1 second, and the time difference will not be so obvious.

The first threshold and second threshold are also set to 70% and 50% for example only, are not limited thereto, and other values can be used instead. A configuration that uses additional threshold values and sets the prohibition periods in finer increments is also conceivable.

The period counting unit 94 counts the time from when the prohibition periods are set by the prohibition period setting unit 93. Because the prohibition period setting unit 93 sets the prohibition periods in day units in this embodiment as described above, the period counting unit 94 counts the number of days passed since the prohibition periods were set. The period counting unit 94 increments the number of days by 1 at 00:00 the next day.

For example, if the prohibition period is set to 1 day at 14:00, the prohibition period expires at 00:00 that night because the period counting unit 94 sets the number of days to 1 day at 00:00 of the next day. Likewise, if the prohibition period is set to 2 days, the period counting unit 94 sets the number of days to 2 days at 00:00 the day after next, and the prohibition period is cancelled at that 00:00.

The period counting unit 94 counts the number of days separately for manual reception and automatic reception. As a result, when the manual reception prohibition period expires, the number of days counted for manual reception is reset, but if the automatic reception prohibition period has not expired, the number of days counted for that prohibition period is not reset. When automatic reception prohibition period then expires, the number of days counted for automatic reception is also reset.

The period counting unit 94 in this embodiment of the invention increments the number of days by 1 at 00:00 as described above, but the invention is not so limited and the number of days could be incremented at some other time. If the prohibition period is set to a period of less than 1 day, such as 12 hours, the number of hours passed from when the prohibition period was set may be counted instead.

The restriction cancelling unit 95 cancels the prohibition period set by the prohibition period setting unit 93 and resets the number of days counted by the period counting unit 94 under specific conditions.

In this embodiment the restriction cancelling unit 95 monitors the result from the remaining power meter 5, and determines if the remaining battery capacity is a specific value (such as 90%) that is greater than the first threshold. If the remaining battery capacity is this specific value or greater, the restriction cancelling unit 95 cancels the set prohibition periods (both the automatic reception prohibition period and the manual reception prohibition period), and resets the day counts of the period counting unit 94.

As a result, when the power supply 4 has been sufficiently charged by the power generator 6, the prohibition period is cancelled and the wristwatch 1 can again receive satellite signals from the GPS satellites SL.

The manual reception unit 96 causes the receiver 8 to receive satellite signals according to user operation of the operating unit 3. The manual reception unit 96 includes a condition evaluation unit 961, timekeeping mode execution unit 962, and positioning mode execution unit 963.

When the operating unit 3 is operated to manually (unconditionally) start receiving satellite signals, the condition evaluation unit 961 determines if the prohibition period set by the prohibition period setting unit 93 is in effect. If a prohibition period is not enabled, the condition evaluation unit 961 determines based on the user operation whether to receive the satellite signals and adjust the time in the timekeeping mode or the positioning mode.

If the condition evaluation unit 961 determines to use the timekeeping mode, the timekeeping mode execution unit 962 functions.

The timekeeping mode is a mode in which a satellite signal is received from at least one GPS satellite SL, and the time adjustment unit 99 described below adjusts the internal time kept by the timekeeping unit 91 based on the time information contained in the received satellite signal.

As a result, the timekeeping mode execution unit 962 controls the receiver 8 and causes the receiver 8 to receive a satellite signal from at least one GPS satellite SL.

If the condition evaluation unit 961 detects the positioning mode, the positioning mode execution unit 963 functions.

The positioning mode is a mode in which satellite signals are received from at least three (and preferably at least four) GPS satellites SL, and the time adjustment unit 99 adjusts the internal time based on the time information and positioning information contained in the satellite signals.

As a result, the positioning mode execution unit 963 controls the receiver 8 and causes the receiver 8 to receive satellite signals from at least three GPS satellites SL.

If a prohibition period is not enabled and specific reception conditions are met, the automatic reception unit 97 controls the receiver 8 to receive a satellite signal. This automatic reception unit 97 includes a condition evaluation unit 971, an environment-based automatic reception unit 972, and a scheduled automatic reception unit 973.

The condition evaluation unit 971 is an example of a first condition evaluation unit and second condition evaluation unit in the accompanying claims.

The condition evaluation unit 971 determines if a prohibition period is enabled, and if a prohibition period is not enabled, determines whether or not the conditions for automatic reception are met. More specifically, the condition evaluation unit 971 determines if the current environment enables receiving satellite signals.

More specifically, based on the power generation detected by the power output detector 7, the condition evaluation unit 971 determines if the wristwatch 1 is in an environment where satellite signals can be received (such as outdoors or beside a window). This is because when the power generator 6 is generating power efficiently and the generated power detected by the power output detector 7 is relatively high, the wristwatch 1 is typically outdoors or located beside a window, and the environment can therefore be determined to enable receiving satellite signals.

The condition evaluation unit 971 also determines if the internal time has reached the automatic reception time. This automatic reception time can be preset in the wristwatch 1 at the factory, or set by the user operating the operating unit 3.

If the condition evaluation unit 971 determines the wristwatch 1 is in an environment enabling satellite signal reception, the environment-based automatic reception unit 972 controls the receiver 8 to receive satellite signals.

When the condition evaluation unit 971 determines the internal time has reached the automatic reception time, the scheduled automatic reception unit 973 controls the receiver 8 to receive satellite signals.

Satellite signal reception by the environment-based automatic reception unit 972 and scheduled automatic reception unit 973 is in the timekeeping mode described above. More specifically, the environment-based automatic reception unit 972 and scheduled automatic reception unit 973 cause the receiver 8 to receive a satellite signal from at least one GPS satellite SL, and acquire the time information contained in the received satellite signal.

Note that the environment-based automatic reception unit 972 and scheduled automatic reception unit 973 could also be configured to receive satellite signals in the positioning mode. For example, the environment-based automatic reception unit 972 could execute the timekeeping mode and the scheduled automatic reception unit 973 could execute the positioning mode.

The decision unit 98 determines if satellite signals were successfully received by the receiver 8 as controlled by the manual reception unit 96 and automatic reception unit 97.

When the decision unit 98 determines satellite signals were received, the time adjustment unit 99 adjusts the internal time kept by the timekeeping unit 91 based on the time information acquired by the manual reception unit 96 and automatic reception unit 97. If positioning information was also acquired with the time information, the standard time (local time) at the current position is calculated from the time information and positioning information, and the internal time is adjusted based on this standard time.

Reception Process

As described above, the wristwatch 1 adjusts the internal time by receiving satellite signals from GPS satellites SL. To accomplish this, the controller 9 controls a manual reception process executed primarily by the manual reception unit 96, or an automatic reception process executed primarily by the automatic reception unit 97.

This manual reception process and automatic reception process are described below.

Manual Reception Process

Figure 4:
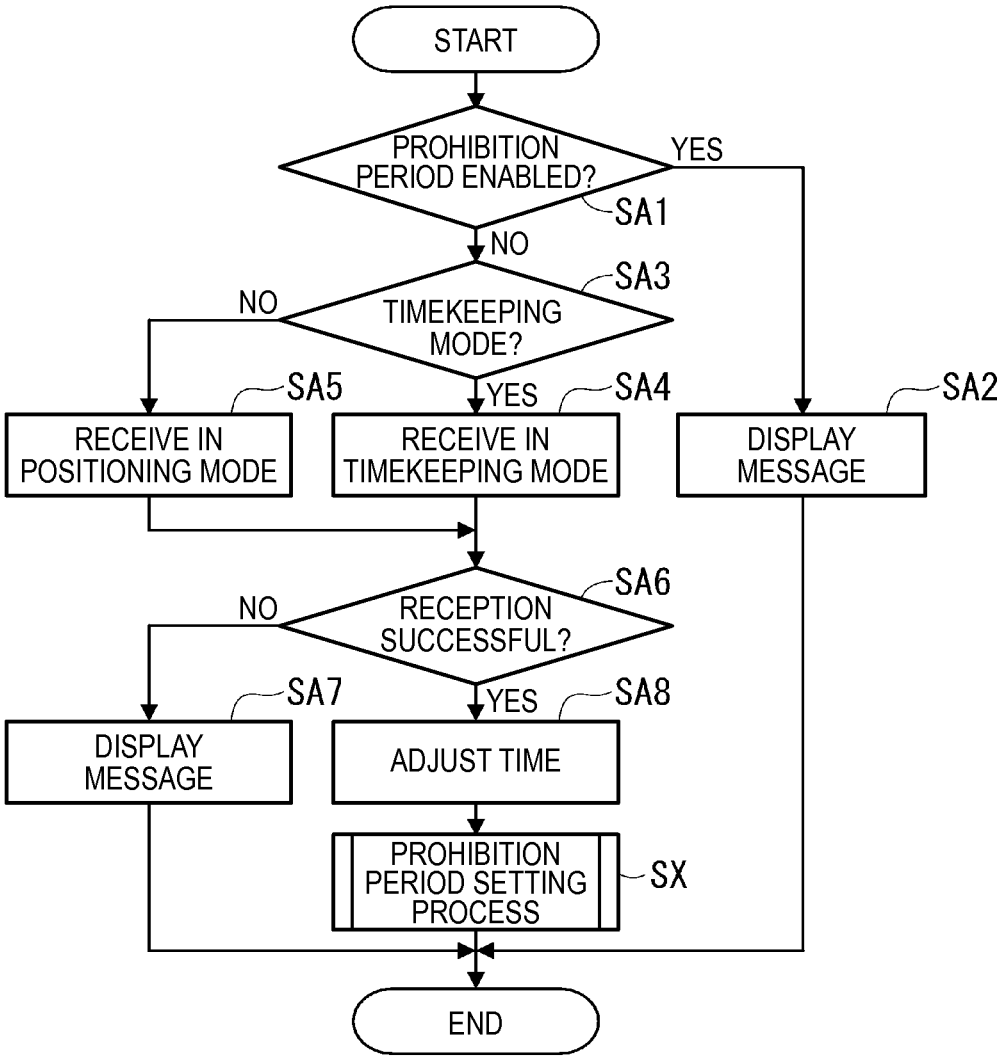
FIG. 4 is a flow chart showing a manual reception process in this embodiment of the invention.

FIG. 4 is a flow chart of the manual reception process.

The manual reception process is executed when the operating unit 3 is manipulated to start the operation for receiving a satellite signal to adjust the internal time.

In the manual reception process as shown in FIG. 4, the condition evaluation unit 961 of the manual reception unit 96 first determines if the prohibition period described above is enabled (step SA1).

If the condition evaluation unit 961 determines the prohibition period is enabled, the display control unit 92 causes the display unit 2 to display a message indicating that a satellite signal cannot be received because the prohibition period is enabled (step SA2). The controller 9 then ends the manual reception process.

If the condition evaluation unit 961 determines the prohibition period is not enabled, the condition evaluation unit 961 determines whether the user operation selected the timekeeping mode or the positioning mode (step SA3).

If step SA3 determines the operation selected the timekeeping mode, the timekeeping mode execution unit 962 controls the receiver 8 to execute the satellite signal reception process in the timekeeping mode described above (step SA4).

If step SA3 determines the operation selected the positioning mode, the positioning mode execution unit 963 controls the receiver 8 to execute the satellite signal reception process in the positioning mode described above (step SA5).

After step SA4 or step SA5, the decision unit 98 determines if satellite signal reception was successful (step SA6).

If a satellite signal could not be received, the display control unit 92 causes the display unit 2 to display a message that a satellite signal could not be received and the time could not be adjusted (step SA7). The controller 9 then ends the manual reception process.

However, if satellite signal reception was successful, the time adjustment unit 99 adjusts the time based on the time information (timekeeping mode and positioning mode) and positioning information (positioning mode) contained in the received satellite signals (step SA8).

The controller 9 then executes the prohibition period setting process SX.

Prohibition Period Setting Process

Figure 5:
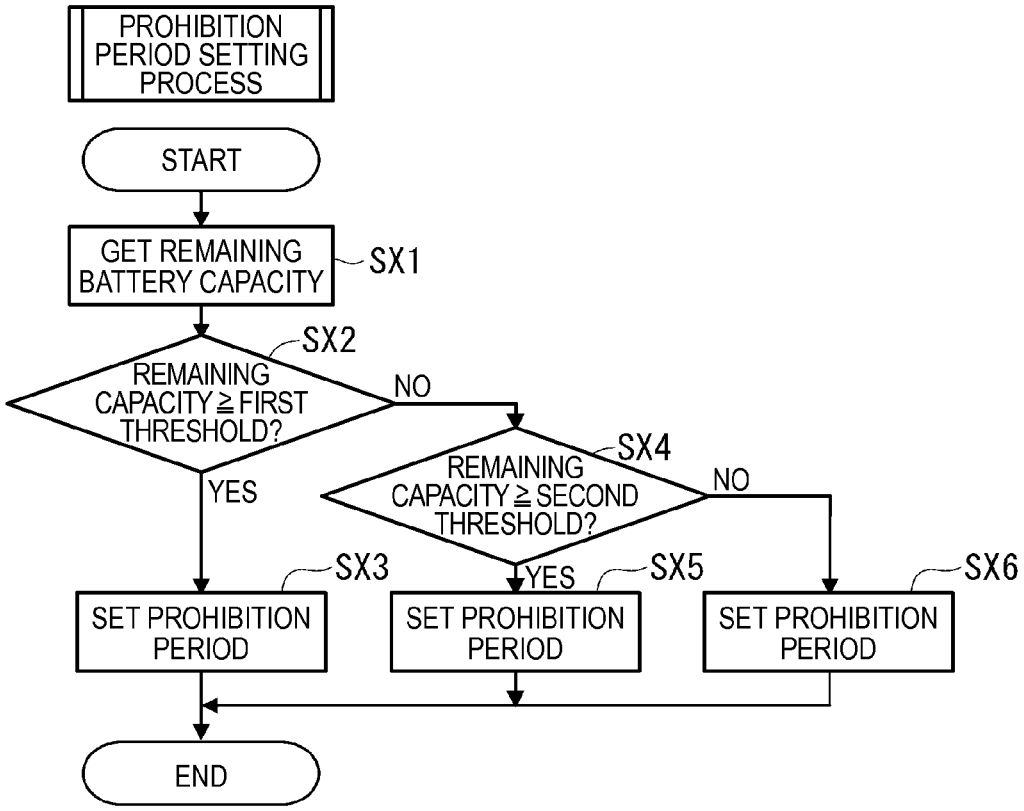
FIG. 5 is a flow chart showing the prohibition period setting process in this embodiment of the invention.

FIG. 5 is a flow chart of the prohibition period setting process SX.

The prohibition period setting process SX is a process that is executed when a satellite signal was received.

In the prohibition period setting process SX as shown in FIG. 5, the prohibition period setting unit 93 first gets the remaining battery capacity of the power supply 4 detected by the remaining power meter 5 (step SX1).

Next, the prohibition period setting unit 93 determines if the acquired remaining battery capacity is greater than or equal to the first threshold (step SX2).

If the remaining battery capacity is greater than or equal to the first threshold, the prohibition period setting unit 93 sets the prohibition periods for automatic reception and manual reception to time T11 and T21 described above (step SX3). The controller 9 then ends the prohibition period setting process SX.

If the remaining battery capacity is not greater than or equal to the first threshold, the prohibition period setting unit 93 determines if the remaining battery capacity is greater than or equal to the second threshold, which is less than the first threshold (step SX4).

If this step determines that the remaining battery capacity is greater than or equal to the second threshold, the prohibition period setting unit 93 sets the prohibition periods for automatic reception and manual reception to times T12 and T22 described above (step SX5). The controller 9 then ends the prohibition period setting process SX.

If the remaining battery capacity is not greater than or equal to the second threshold (is less than the second threshold), the prohibition period setting unit 93 sets the prohibition periods for automatic reception and manual reception to times T13 and T23 described above (step SX6). The controller 9 then ends the prohibition period setting process SX.

Completion of the prohibition period setting process SX ends the manual reception process.

Figure 6:
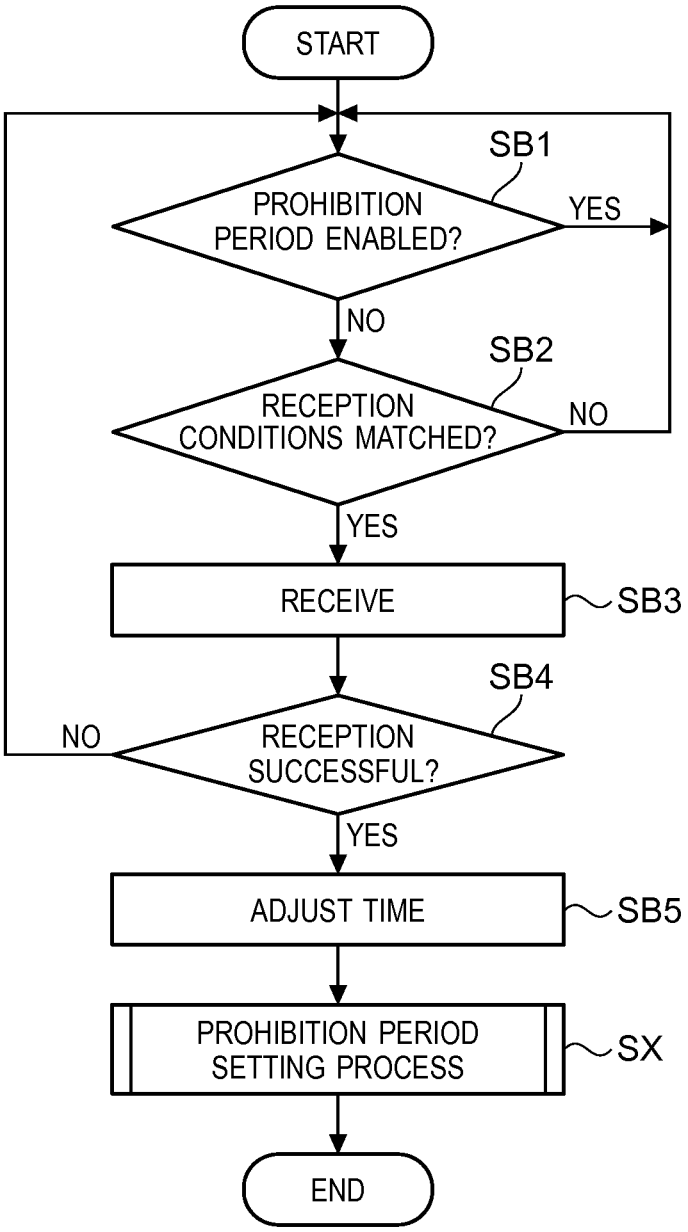
FIG. 6 is a flow chart of the automatic reception process in this embodiment of the invention

FIG. 6 is a flow chart of the automatic reception process.

The automatic reception process is described next.

In the automatic reception process as shown in FIG. 6, the condition evaluation unit 971 of the automatic reception unit 97 determines if the prohibition period described above is enabled (step SB1). If a prohibition period is enabled, the controller 9 returns the process to step SB1.

If the condition evaluation unit 971 determines a prohibition period is not enabled, the condition evaluation unit 971 determines if the state of the wristwatch 1 matches the automatic reception conditions described above (step SB2). More specifically, based on the generated power detected by the power output detector 7, the condition evaluation unit 971 determines if the wristwatch 1 is in an environment where satellite signals can be received, and if the internal time has reached the automatic reception time.

If step SB2 determines the conditions are not compatible with automatic reception (the current environment does not enable receiving satellite signals, it is not the automatic reception time), the controller 9 returns the process to step SB1.

However, if the conditions are determined to be compatible with automatic reception, the automatic reception unit 97 causes the receiver 8 to receive satellite signals (step SB3). In this case, if the condition evaluation unit 971 determines the environment enables receiving satellite signals, the environment-based automatic reception unit 972 causes the receiver 8 to receive a satellite signals. If the condition evaluation unit 971 determines the automatic reception time has been reached, the scheduled automatic reception unit 973 causes the receiver 8 to receive a satellite signals.

The decision unit 98 then determines if satellite signal reception was successful (step SB4). If it determines that reception was not successful, the controller 9 returns the process to step SB1.

If reception was successful, the time adjustment unit 99 adjusts the internal time based on the time information contained in the received satellite signal (step SB5).

The controller 9 then executes the prohibit ion period setting process SX described above, and ends the automatic reception process.

The automatic reception and manual reception prohibition periods set by the prohibition period setting unit 93 when satellite signal reception is successful are cancelled as described above when the number of days counted by the period counting unit 94 exceeds the prohibition period. The prohibition periods are also cancelled by the restriction cancelling unit 95 when the remaining battery capacity is determined to be the specific value or higher as described above.

As a result, because the prohibition periods are cancelled at an appropriate time according the remaining battery capacity of the wristwatch 1, the duration time of the wristwatch 1 can be increased because power consumption from frequently receiving satellite signals can be suppressed. In addition, because the internal time can be adjusted at a suitable timing, the correct current time can be displayed.

Effect of the Invention

The effect of the wristwatch 1 according to this embodiment of the invention is described below.

The time adjustment unit 99 adjusts the internal time kept by the timekeeping unit 91 based at least on the time information contained in the satellite signals received by the receiver 8. As a result, the wristwatch 1 can keep the correct time.

In addition, the prohibition period setting unit 93 sets a prohibition period during which satellite signal reception by the receiver 8 is prohibited based on the remaining battery capacity monitored by the remaining power meter 5. As a result, power for driving the wristwatch 1 can be assured because the reception process, which requires a relatively large amount of power, is not executed during the prohibition period.

The internal time can therefore be adjusted and the correct time can be kept, and consuming a large amount of power by frequently receiving satellite signals can be suppressed. As a result, the duration time of the wristwatch 1 can be increased, and sudden system shutdowns due to insufficient power can be suppressed.

Of the prohibition periods set when the remaining battery capacity measured by the remaining power meter 5 is less than the first threshold, the automatic reception prohibition periods (times T12, T13) are longer than the prohibition period (time T11) set when the remaining capacity is greater than or equal to the first threshold, and the manual reception prohibition periods (times T22, T23) set in the same way are longer than the prohibition period (time T21) set when the remaining capacity is greater than or equal to the first threshold. As a result, because a short prohibition period is set when there is sufficient remaining battery capacity, a state enabling satellite signal reception can be restored in a short time. The difference between the internal time and the actual current time can therefore be minimized by adjusting the time as needed. In addition, because a long prohibition period is set when the remaining battery capacity is low, power sufficient to drive wristwatch 1 operations other than receiving satellite signals can be reliably assured.

The restriction cancelling unit 95 cancels the set prohibition period when the remaining battery capacity rises to a specific value that is greater than the first threshold. As a result, the receiver 8 can receive satellite signals. The current time can therefore be kept more correctly when there is sufficient remaining battery capacity by increasing the frequency of satellite signal reception.

The restriction cancelling unit 95 cancels the prohibition periods once a day. Unnecessary power consumption can therefore be suppressed because the prohibition periods are not set and cancelled frequently. The power required to drive the wristwatch 1 can therefore be assured even more reliably.

When the remaining battery capacity is less than the first threshold, a long prohibition period (times T12, T13, and times T22, T23) is set according to the remaining capacity. As a result, the frequency of satellite signal reception which requires much power can be suppressed. Power sufficient to drive wristwatch 1 operations other than receiving satellite signals can be reliably assured.

Prohibition of manual reception can also be cancelled sooner than prohibition of automatic reception because the prohibition period setting unit 93 sets the automatic reception prohibition period longer than the manual reception prohibition period (in other words, sets the manual reception prohibition period shorter than the automatic reception prohibition period). Because receiving satellite signals in response to user operations is thus easier, wristwatch 1 ease of use can be improved.

If the condition evaluation unit 971 determines that the wristwatch 1 is in an environment where satellite signals can be received when a prohibition period has not been set, the environment-based automatic reception unit 972 causes the receiver 8 to receive the satellite signals. As a result, because the satellite signal reception process is executed when conditions are determined to enable satellite signal reception, frequently executing the reception process can be suppressed. Unnecessary power consumption can therefore be suppressed.

Because the power generator 6 has a solar panel that generates power according to the incident light, power output increases as the amount of incident light increases. In other words, high power output can be used to determine that strong light such as sunlight is incident. As a result, if the condition evaluation unit 971 determines that the generated power detected by the power output detector 7 is relatively high, the power generator 6 can be determined to be exposed to daylight, and the wristwatch 1 can be determined to be outdoors or beside a window. Because satellite signals can be received in such an environment, the condition evaluation unit 971 can determine whether or not the wristwatch 1 is in an environment enabling satellite signal reception based on the power output of the power generator 6. In addition to determining whether or not the wristwatch 1 is in an environment where satellite signals can be received, executing the satellite signal reception process in an environment where reception is not possible can be suppressed, and unnecessary power consumption can be suppressed.

If a prohibition period has not been set and the condition evaluation unit 971 determines that the internal time has reached a preset automatic reception time, the scheduled automatic reception unit 973 causes the receiver 8 to receive satellite signals. As a result, satellite signals can be received and the internal time can be adjusted when satellite signal reception is possible even if the user does not start reception manually. The wristwatch 1 is therefore easier to use.

Other Embodiments

The invention is not limited to the embodiment described above, and variations and improvements that also achieve the object of the invention are included in the scope of the invention.

The prohibition period setting unit 93 in the foregoing embodiment sets the prohibition period in 1-day units according to the remaining battery capacity, but the invention is not so limited. For example, the prohibition period could be set in 1-hour units. In this case, as described above, the period counting unit may be configured to count the number of hours passed after the prohibition period is set.

The first threshold is set to 70% of battery capacity, and the second threshold is set to 50% of battery capacity, in the embodiment described above, but the invention is not so limited. These thresholds can be set as desired.

The specific value evaluated by the restriction cancelling unit 95 in the foregoing embodiment is 80% of battery capacity, but the invention is not so limited and these thresholds can be set as desired.

The restriction cancelling unit 95 cancels the prohibition period once a day in the foregoing embodiment, but the invention is not so limited. More specifically, the prohibition period could be cancelled plural times in one day based on the battery capacity and remaining battery capacity.

The foregoing embodiment has a timekeeping mode execution unit 962 that receives satellite signals in a timekeeping mode, and a positioning mode execution unit 963 that receives satellite signals in a positioning mode, during manual reception, but the invention is not so limited. More specifically, either mode is sufficient, and a configuration that does not perform a manual reception process is also conceivable.

The power generator 6 in the foregoing embodiment has a solar panel, and the condition evaluation unit 971 uses the power output of the power generator 6 detected by the power output detector 7 as a reference for determining whether or not the wristwatch 1 is in an environment where satellite signals can be received, but the invention is not so limited. For example, whether or not the receiver 8 can receive satellite signals can be determined using other information.

The prohibition period setting unit 93 in the foregoing embodiment sets a prohibition period of a length corresponding to the remaining battery capacity. The prohibition period setting unit 93 sets a predetermined number of days in this case, but a table correlating remaining capacity to the prohibition period could be stored, and the prohibition period setting unit 93 could set the prohibition period based on this table.

A wristwatch that is worn by the user is used as an example of an electronic timepiece in the foregoing embodiment, but the invention is not so limited. For example, the invention can also be applied to table clocks and wall clocks. An electronic timepiece according to the invention can also be incorporated in a cell phone or other electronic device.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2011-187590, filed Aug. 30, 2011 is expressly incorporated by reference herein.

What is claimed is:

1. An electronic timepiece comprising:

a reception unit that receives a satellite signal containing time information from a positioning information satellite;

a power supply unit having a battery that supplies drive power;

a remaining capacity detection unit that measures the remaining battery capacity; and a control unit that controls satellite signal reception by the reception unit, and includes a timekeeping unit that keeps time, a time adjustment unit that adjusts the time kept by the timekeeping unit based on the satellite signal received by the reception unit, and a prohibition period setting unit that sets a first prohibition period in which receiving a satellite signal is prohibited when the remaining battery capacity, as measured by the remaining capacity detection unit, is greater than or equal to a threshold, and sets a second prohibition period in which receiving a satellite signal is prohibited when the remaining battery capacity, as measured by the remaining capacity detection unit, is less than the threshold, the second prohibition period being longer than the first prohibition period.

2. The electronic timepiece described in claim 1, wherein:

the control unit has a restriction cancelling unit that cancels the first prohibition period when the remaining battery capacity becomes greater than or equal to a specific value that is higher than the threshold.

3. The electronic timepiece described in claim 2, wherein:

cancellation of the first prohibition period by the restriction cancelling unit is limited to once a day.

4. The electronic timepiece described in claim 1, wherein:

the prohibition period setting unit sets a third prohibition period that is longer than the second prohibition period as the prohibition period when the remaining battery capacity is less than a second threshold that is less than the threshold.

5. The electronic timepiece described in claim 1, wherein:

the control unit includes an automatic reception unit that executes an automatic reception process causing the reception unit to receive the satellite signal when the state of the electronic timepiece matches a specific reception condition, and a manual reception unit that executes a manual reception process causing the reception unit to receive the satellite signal when a specific operation of the electronic timepiece is performed.

6. The electronic timepiece described in claim 5, wherein:

the automatic reception unit includes a first condition evaluation unit that determines if the electronic timepiece is in an environment where the satellite signal can be received, and an environment-based automatic reception unit that causes the reception unit to receive the satellite signal when the first condition evaluation unit determines that the environment enables reception.

7. The electronic timepiece described in claim 6, further comprising:

a power generating unit that produces power according to incident light and charges the battery; and a power output detection unit that detects the power output of the power generating unit;

wherein the first condition evaluation unit determines if the environment enables receiving the satellite signal based on the power output detected by the power output detection unit.

8. The electronic timepiece described in claim 5, wherein:

the automatic reception unit has a second condition evaluation unit that determines if the time kept by the timekeeping unit reached a preset automatic reception time, and a scheduled automatic reception unit that receives the satellite signal by the reception unit when the second condition evaluation unit determines that the automatic reception time was reached.

* * * * *